US009482234B2

(12) United States Patent
Endo et al.

(10) Patent No.: US 9,482,234 B2
(45) Date of Patent: Nov. 1, 2016

(54) CONSTRUCTION MACHINE INCLUDING HYDRAULIC PUMP

(71) Applicant: KOBELCO CONSTRUCTION MACHINERY CO., LTD., Hiroshima (JP)

(72) Inventors: Kazuomi Endo, Hiroshima (JP); Koichiro Mori, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 327 days.

(21) Appl. No.: 14/183,855

(22) Filed: Feb. 19, 2014

(65) Prior Publication Data

US 2014/0255212 A1 Sep. 11, 2014

(30) Foreign Application Priority Data

Mar. 5, 2013 (JP) ..... 2013-042830

(51) Int. Cl.
*F04D 25/02* (2006.01)
*E02F 9/22* (2006.01)

(52) U.S. Cl.
CPC ..... *F04D 25/02* (2013.01); *E02F 9/2221* (2013.01); *E02F 9/2296* (2013.01)

(58) Field of Classification Search
CPC ..... E02F 9/2221; E02F 9/2296; F04D 25/02
USPC ..... 60/431, 445
See application file for complete search history.

(56) References Cited

U.S. PATENT DOCUMENTS

2006/0118082 A1 6/2006 Nakamura et al.
2008/0236157 A1 10/2008 Kowatari et al.
2009/0293470 A1* 12/2009 Tsukamoto ..... E02F 9/2228 60/459

FOREIGN PATENT DOCUMENTS

EP 1 637 718 A1 3/2006
EP 2 017 482 A1 1/2009

(Continued)

OTHER PUBLICATIONS

Extended European Search Report issued Sep. 23, 2014 in Patent Application No. 14156955.8.

(Continued)

*Primary Examiner* — Thomas E Lazo
(74) *Attorney, Agent, or Firm* — Oblon, McClelland, Maier & Neustadt, L.L.P

(57) ABSTRACT

Provided is a construction machine including an engine, a hydraulic pump with a supercharger, and a hydraulic actuator, being capable of attaining both of a quick rise of engine speed and an operation of the hydraulic actuator during the rise of the engine speed. The construction machine further includes a supercharging pressure detector to detect a supercharging pressure of the supercharger and a controller to control absorption torque of the hydraulic pump, namely, pump torque. Until engine speed of the engine reaches target engine speed, the controller calculates target pump torque from a predetermined relationship between engine no-load speed and the target pump torque, corrects the target pump torque so as to make it smaller as the detected supercharging pressure is lower, and limits actual pump torque to the corrected target pump torque, until engine speed reaches target engine speed from engine speed lower than the target engine speed.

3 Claims, 3 Drawing Sheets

(56) References Cited

FOREIGN PATENT DOCUMENTS

| | | | |
|---|---|---|---|
| JP | 5-312082 | | 11/1993 |
| JP | 05312082 A | * | 11/1993 |
| JP | 2005-76670 A | | 3/2005 |
| JP | 2008-128107 A1 | | 6/2008 |

OTHER PUBLICATIONS

Japanese Office Action issued Feb. 3, 2015 in Patent Application No. 2013-042830 (with Partial English Translation).

* cited by examiner

CONSTRUCTION MACHINE INCLUDING HYDRAULIC PUMP

BACKGROUND OF THE INVENTION

1. Technical Field

The present invention relates to a control apparatus that controls pump torque so as to raise engine speed from low engine speed to target engine speed quickly in a construction machine such as an excavator.

2. Description of the Related Art

A related art of the present invention is explained with reference to an excavator as an example.

The engine speed during no load of an engine mounted on the excavator is usually set according to an operation applied to an engine speed setting device called acceleration potentiometer, selection of a work mode, and the like. When there are a plurality of determination elements, a lower value is selected. By use of the set engine speed as a target engine speed, a fuel injection quantity in the engine is controlled.

On the other hand, in an excavator with an auto-deceleration function, there is performed an auto-deceleration control for reducing engine speed to set engine speed, i.e., deceleration engine speed, when a predetermined deceleration condition (e.g., a fixed time elapses after lever operation is stopped) is met. When the deceleration condition is not met, for example, when a lever operation is performed, performed is a return-from-deceleration control for raising the engine speed to target engine speed.

In this case, if an actuator is operated during a return from deceleration, the engine speed is not smoothly raised because of a pump load and the engine speed is delayed in reaching the target engine speed. As a solution to this problem, Japanese Patent Application Laid-open No. H5-312082 discloses a technique for reducing an engine load and quickening a rise of engine speed by minimizing pump torque, which is absorption torque of a hydraulic pump, during the start of an engine; however, minimizing the pump torque in this way makes it impossible to substantially perform an actuator operation, i.e., excavator work until the engine speed completely rises. This problem can occur not only during the return from deceleration but also during raising of the engine speed from low engine speed to target engine speed including engine start.

SUMMARY OF THE INVENTION

It is an object of the present invention to provide a construction machine including an engine, a hydraulic pump, and a hydraulic actuator, the construction machine being capable of attaining both of a quick rise of engine speed and an operation of the hydraulic actuator during the rise of the engine speed.

A construction machine provided by the present invention includes: an engine with a supercharger; a variable-displacement hydraulic pump driven by the engine; a hydraulic actuator driven by hydraulic fluid discharged from the hydraulic pump; a supercharging pressure detector adapted to detect a supercharging pressure of the supercharger; and a controller adapted to control pump torque, which is absorption torque of the hydraulic pump. The controller is adapted to perform calculating target pump torque from a predetermined relationship between engine no-load speed and the target pump torque, correcting the target pump torque so as to reduce the target pump torque as the supercharging pressure is lower, on the basis of the supercharging pressure detected by the supercharging pressure detector, and limiting actual pump torque to the corrected target pump torque, until engine speed of the engine reaches target engine speed from engine speed lower than the target engine speed.

EMBODIMENTS OF THE INVENTION

Figure 1:
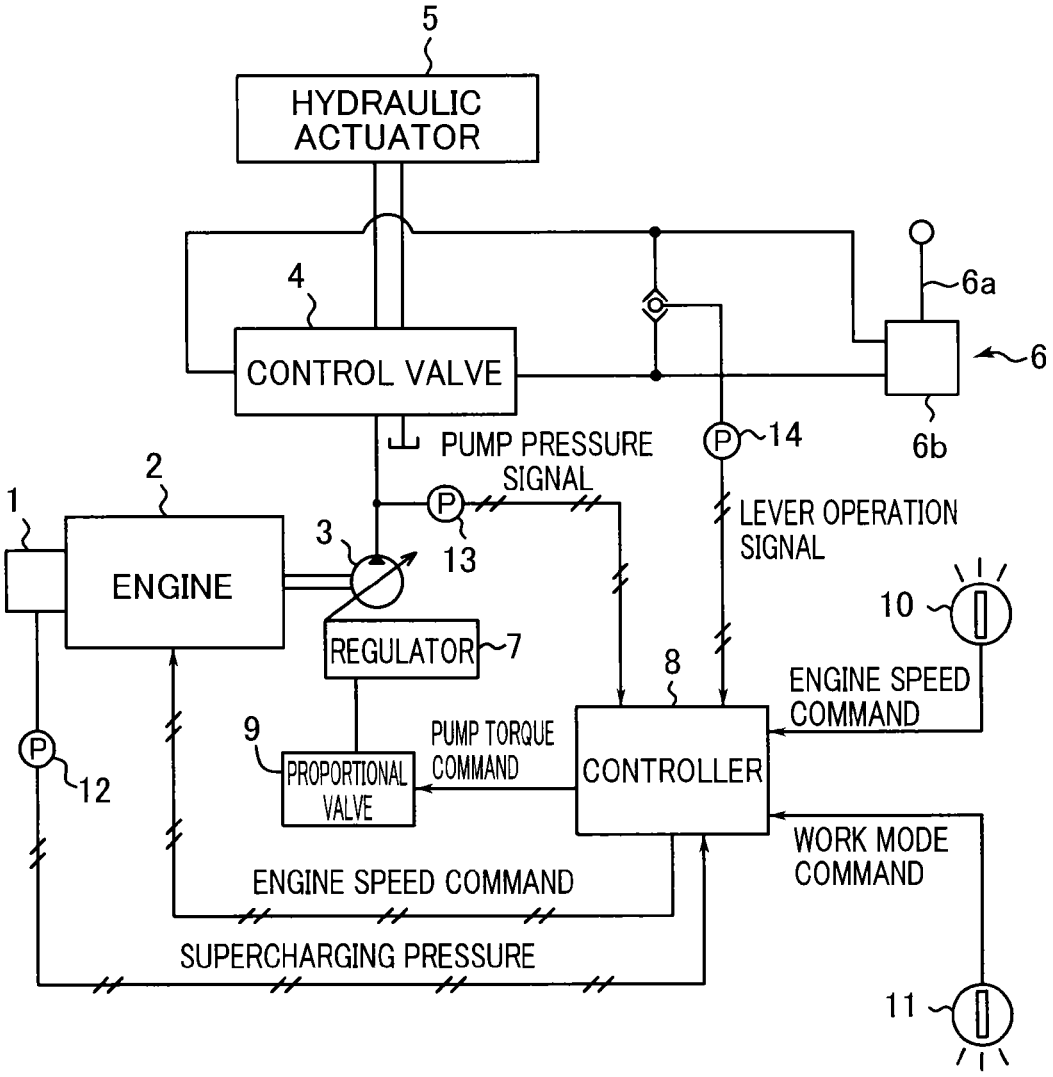
FIG. 1 is a block diagram showing main components of a construction machine according to an embodiment of the present invention.

FIG. 1 shows main components of a construction machine according to an embodiment of the present invention. The construction machine includes an engine 2 including a supercharger (turbocharger) 1, a hydraulic pump 3 driven by the engine 2 to discharge hydraulic fluid, a hydraulic actuator 5 adapted to be operated with supply of the hydraulic fluid discharged from the hydraulic pump 3, a control valve 4 adapted to be operated to switch a state of the supply of the hydraulic fluid from the hydraulic pump 3 to the hydraulic actuator 5, a remote control valve 6 to which an operation for the switching of the control valve 4 is applied, and a controller 8. The remote control valve 6 includes an operation lever 6*a* and a valve main body 6*b* adapted to output a pilot pressure for actuating the control valve 4, on the basis of the operation applied to the operation lever 6*a*.

The hydraulic pump 3 is a variable-displacement hydraulic pump, tilting of which is controlled by the controller 8 via a regulator 7 and a proportional valve 9. The controller 8 inputs a pump torque command (a tilting command) into the proportional valve 9 to thereby cause the regulator 7 to change the tilting of the hydraulic pump 3. Specifically, the controller 8 performs, by inputting the pump torque command to the proportional valve 9, so-called PQ control for controlling the tilting of the hydraulic pump 3 to control a pump rate, which is a flow rate of the hydraulic fluid discharged by the hydraulic pump 3, on the basis of a pump pressure, i.e., a discharge pressure of the hydraulic pump 3, so as to hinder pump torque, which is absorption torque of the hydraulic pump 3, from exceeding engine torque.

The construction machine according to this embodiment also includes a plurality of components for determining no-load engine speed of the engine 2, namely, an engine speed setting device 10 and a work mode selection switch 11. The controller 8 sets a lower selected value of engine no-load speeds as target engine speed, the lower selected value being determined based on the components and an operation amount of the operation lever 6*a* in the remote control valve 6.

The controller 8 inputs a command concerning the target engine speed thus determined to a not-shown governor control section of the engine 2 to thereby perform control of engine speed based on the target engine speed. The controller 8 also performs auto-deceleration control for reducing the engine speed to low engine speed, i.e., predetermined deceleration engine speed, when a predetermined deceleration condition is met, for example, a condition that no operation is applied to the operation lever 6*a* continuously for a set time is met, and performs return-from-deceleration control for causing the engine speed to the target engine speed when the deceleration condition is not met.

On the other hand, the construction machine includes a plurality of detectors, namely: a supercharging pressure sensor 12 adapted to detect a supercharging pressure (a boost pressure) of the supercharger 1; a pump pressure sensor 13 adapted to detect the pressure of the hydraulic fluid discharged by the hydraulic pump 3, i.e., a pump pressure; and a pilot pressure sensor 14 adapted to detect a pilot pressure of the remote control valve 6 as information concerning presence or absence of operation applied to the operation lever 6*a* and an operation amount of the operation lever 6*a*. The sensors 12 to 14 generate respective signals, which are input to the controller 8.

The controller 8 performs the following processing until the engine speed reaches the target engine speed from the deceleration engine speed during the return-from-deceleration control:

(i) target pump torque calculation processing for calculating target pump torque from a map of engine no-load speed (target engine speed)/target pump torque given in advance; and (ii) target pump torque correction processing for correcting the calculated target pump torque so as to make the target pump torque be smaller on a low supercharging pressure side, according to an engine supercharging pressure, and limiting actual pump torque to the corrected target pump torque corrected in this way.

The processing is explained detail below. Table 1 shown below indicates contents of the map prepared concerning a relationship between the engine no-load speed and the target pump torque for performing the target pump torque calculation processing. "H mode", "S mode", and "E mode" in Table 1 represent a heavy work mode, a standard work mode, and an ecological work mode, respectively. Each of the modes is given target pump torque corresponding to engine target speed, i.e., no-load engine speed. The target pump torque is set to a value based on respective engine no-load speeds determined concerning such a plurality of modes, for example, a lower selected value of the engine no-load speeds.

TABLE 1

| Engine target speed (no-load engine speed) N0 (rpm) | H mode Target pump torque Tq (N · m) | S mode Target pump torque Tq (N · m) | E mode Target pump torque Tq (N · m) |
|---|---|---|---|
| N0(1) | Tq(1) | Tq(1) | Tq(1) |
| N0(2) | Tq(2) | Tq(2) | Tq(2) |
| . . . | . . . | . . . | . . . |
| N0(n) | Tq(n) | Tq(n) | Tq(n) |

Figure 3:
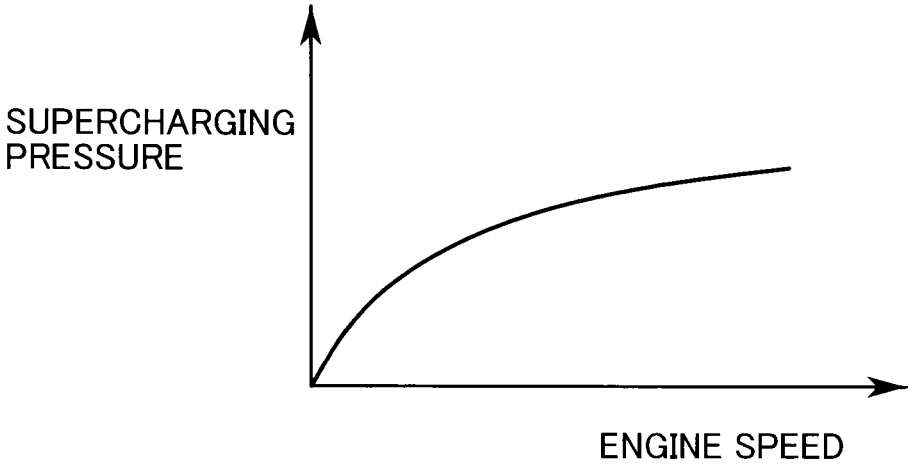
FIG. 3 is a graph showing a relationship between engine speed and a supercharging pressure.
Figure 4:
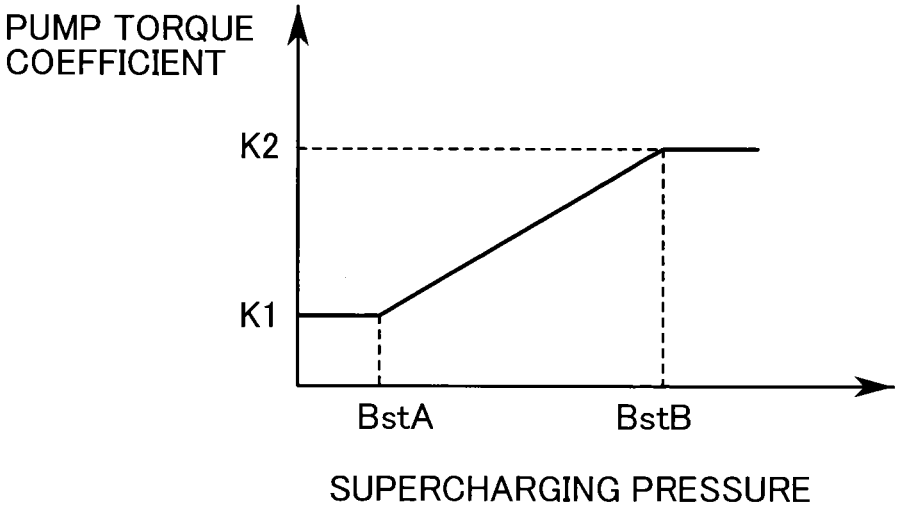
FIG. 4 is a graph showing a relationship between the supercharging pressure and a pump torque coefficient.

FIG. 3 shows a relationship between engine speed and a supercharging pressure of the engine 2. As shown in FIG. 3, the supercharging pressure rises and engine torque increases with an increase in the engine speed. The supercharging pressures, thus, can be an index of torque which the engine 2 can output. Accordingly, the controller 8 performs setting a characteristic of a supercharging pressure/a pump torque coefficient in advance as shown in FIG. 4 and multiplying the target pump torque calculated in the above "(i) target pump torque calculation processing" by a coefficient determined by the supercharging pressure, on the basis of the characteristic. In FIG. 4, "BstA" represents a supercharging pressure for starting a change of the pump torque coefficient, "BstB" represents a supercharging pressure for ending the change, K1 represents a minimum value of the pump torque coefficient, and K2 represents a maximum value of the pump torque coefficient. The controller 8 inputs the target pump torque multiplied by the coefficient to the proportional valve 9 shown in FIG. 1, as a pump torque command for the PQ control.

Figure 2:
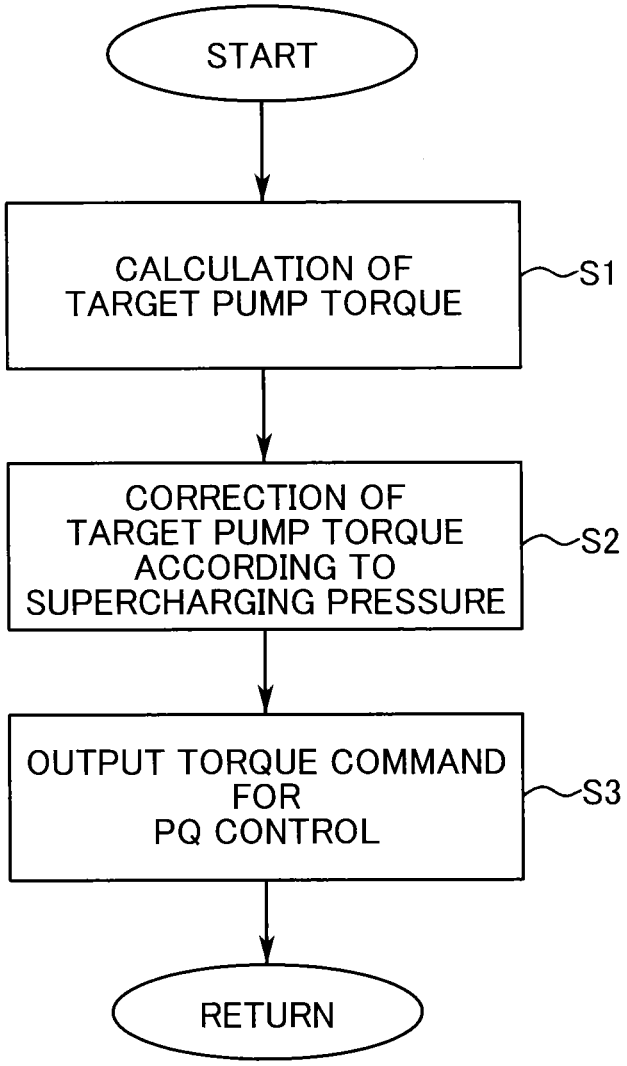
FIG. 2 is a flowchart showing a control action made by a controller included in the construction machine.

FIG. 2 is a flowchart for explaining a specific operation performed by the controller 8. Upon the start of the return-from-deceleration control, the controller 8 performs the target pump torque calculation processing of (i) in step S1. In step S2, the controller 8 performs the target pump torque correction processing corresponding to the supercharging pressure of (ii). In step S3, the controller 8 outputs a torque command for the PQ control.

The controller 8 thus limits the pump torque when the engine speed rises from the deceleration engine, speed which is low engine speed for the auto-deceleration control, to the target engine speed, thereby enabling the engine speed to quickly rise to the target engine speed. In addition, differently from the conventional technique of minimizing the pump torque until the engine speed rises, reducing a degree of limitation of the pump torque according to the rise of the supercharging pressure which is the index of the engine torque makes it possible to keep necessary minimum pump torque while surely raising the engine speed, thus securing an actuator operation in a fixed level. This enables both of a quick start, i.e., a return from deceleration of the engine and the operation of the hydraulic actuator 5 during the return from deceleration to be simultaneously attained.

The control according to the present invention is not limited to one performed during a return from deceleration in the excavator including the auto-deceleration function like the embodiment but can be widely applied when the engine is started from low engine speed.

The construction machine provided by the present invention is not limited to an excavator but may be other construction machines such as a dismantling machine and a crusher adapted by diverting the excavator.

As explained above, according to the present invention, there can be provided a construction machine including an engine, a hydraulic pump, and a hydraulic actuator, the construction machine being capable of attaining both of a quick rise of engine speed and an operation of the hydraulic actuator during the rise of the engine speed. The construction machine includes: an engine with a supercharger; a variable-displacement hydraulic pump driven by the engine; a hydraulic actuator driven by hydraulic fluid discharged from the hydraulic pump; a supercharging pressure detector adapted to detect a supercharging pressure of the supercharger; and a controller adapted to control pump torque, which is absorption torque of the hydraulic pump. The controller is adapted to performs: calculating target pump torque from a predetermined relationship between engine no-load speed and the target pump torque; correcting the target pump torque so as to make the target pump torque be smaller as the supercharging pressure is lower, on the basis of the supercharging pressure detected by the supercharging pressure detector; and limiting actual pump torque to the corrected target pump torque, until engine speed of the engine reaches target engine speed from engine speed lower than the target engine speed.

Thus limiting the pump torque when the engine speed rises from engine speed lower than the target engine speed to the target engine speed makes it possible to quickly raise the engine speed to the target engine speed. Moreover, differently from minimizing the pump torque until the engine is completely started, reducing a degree of limitation of the pump torque according to the rise of the supercharging pressure, which is the index of the engine torque, makes it possible to secure the operation of the hydraulic actuator in a fixed level while surely raising the engine speed.

The controller may be, for example, one including the auto-deceleration function; specifically, the controller may be adapted to perform auto-deceleration control for reducing engine speed to predetermined engine speed when a predetermined deceleration condition is met and perform return-from-deceleration control for raising the engine speed to target engine speed at a point in time when the deceleration condition is not met after the start of the auto-deceleration control. In this case, the controller can realize a quick return from deceleration and securing of the operation of the hydraulic actuator during the return from deceleration by limiting the pump torque to the corrected target pump torque during the return from deceleration.

This application is based on Japanese Patent application No. 2013-042830 filed in Japan Patent Office on Mar. 5, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine comprising:

an engine with a supercharger;

a variable-displacement hydraulic pump driven by the engine;

a hydraulic actuator driven by hydraulic fluid discharged from the hydraulic pump;

a supercharging pressure detector adapted to detect a supercharging pressure of the supercharger; and a controller adapted to control pump torque, which is absorption torque of the hydraulic pump, the controller being adapted to perform, until engine speed of the engine has risen to reach a target engine speed from engine speed lower than the target engine speed, calculating target pump torque from a predetermined relationship between engine no-load speed set and the target pump torque, correcting the target pump torque so as to make the target pump torque be smaller as the supercharging pressure is lower, on the basis of the supercharging pressure detected by the supercharging pressure detector, and limiting actual pump torque to the corrected target pump torque.

2. The construction machine according to claim 1, wherein the controller is adapted to perform auto-deceleration control for reducing the engine speed to set engine speed when a predetermined deceleration condition is met and perform return-from-deceleration control for raising the engine speed to the target engine speed at a point when the deceleration condition is not met after start of the auto-deceleration control, and the controller is adapted to limit the pump torque to the corrected target pump torque during the return from deceleration.

3. The construction machine according to claim 1, wherein the controller is adapted to calculate the target pump torque from the predetermined relationship between engine no-load speed set and the target pump torque for a plurality of relationships between engine no-load speed and the target pump torque for a plurality of operating modes.

* * * * *